US005402888A

United States Patent [19]

Marie

[11] Patent Number: 5,402,888

[45] Date of Patent: Apr. 4, 1995

[54] CARTON WITH SELF LOCKING KEEL

[75] Inventor: Philippe Marie, Chateauroux, France

[73] Assignee: The Mead Corporation, Dayton, Ohio

[21] Appl. No.: 252,022

[22] Filed: Jun. 1, 1994

Related U.S. Application Data

[63] Continuation-in-part of Ser. No. 26,916, Mar. 5, 1993, abandoned.

[51] Int. Cl.[6] ..... B65D 5/04; B65D 75/00

[52] U.S. Cl. ..... 206/426; 206/434; 206/1.5; 229/117.03

[58] Field of Search ..... 229/117.03, 117.04, 229/117.01; 206/1.5, 427, 429, 434, 491, 426, 461, 464

[56] References Cited

U.S. PATENT DOCUMENTS

| | | | |
|---|---|---|---|
| 1,565,765 | 12/1925 | Walters | 229/23 R |
| 2,505,442 | 4/1950 | Thomas | 229/117.04 |
| 3,207,303 | 9/1965 | Breedveld | 206/426 |
| 3,275,215 | 9/1966 | Paige | 229/117.03 |
| 4,164,286 | 8/1979 | Sutherland | 206/434 |
| 4,166,534 | 9/1979 | Bowder | 206/429 |
| 4,574,997 | 3/1986 | Ikeda | 206/434 |
| 4,703,847 | 11/1987 | Oliff | 206/434 X |
| 4,765,535 | 8/1988 | Michetti | 229/172 |
| 4,792,082 | 12/1988 | Williamson | 229/117.01 X |
| 5,107,986 | 4/1992 | Cooper | 206/434 X |

FOREIGN PATENT DOCUMENTS 2521100 12/1986 France .

*Primary Examiner*—Jacob K. Ackun
*Attorney, Agent, or Firm*—Erwin Doerr

[57] ABSTRACT

A carton has a keel structure (K) of rectangular cross section to separate adjacent rows of articles and to retain articles in position. The box keel structure carries a locking tab (38) which is caused to ride over and engage against a ridge (40) formed in an adjacent panel of the carton when the keel is set up from a collapsed to an upright position to maintain the keel upright.

6 Claims, 3 Drawing Sheets

CARTON WITH SELF LOCKING KEEL

This is a continuation-in-part of U.S. patent application Ser. No. 08/026,916, filed Mar. 5, 1993, and now abandoned.

This invention relates to a carton, more usually of the wraparound type, which incorporates an article separating keel which is self supporting once the keel has been erected.

Separating keels used in wraparound cartons have been known for some time. Such keels may be of triangular or rectangular cross section, the latter being known also as "box keels". Typical examples are found in U.S. Pat. Nos. to Sutherland 4,164,286 and Oliff 4,703,847. Separating keels of this type are provided as an integral part of the carton blank and function as both a separator for keeping lower portions of the articles in one row separated from lower portions of the articles in an adjacent row and as a retention device for retaining lower portions of the articles against movement.

In a known arrangement such as shown in French patent No. 8300473, owned by the assignee of this application, a first row of articles, e.g. plastics flanged cups was set in position on a bottom panel of the carton sleeve whereafter the box keel was erected into engagement with the first row of cups and thereafter the second row of cups was put into engagement with the opposite side of the box keel and the formation of the carton then completed.

In the present invention the keel is self-sustaining once it has been erected so that it can be pre-erected prior to loading and formation of the carton.

The invention provides a carton having a box keel structure in which the box keel serves as an article separator and/or retention device, in which cooperating locking means is provided in part by said keel structure and in part by a panel of said carton from which the keel depends, said cooperating locking means being automatically engaged as a consequence of erecting said keel structure.

According to a feature of the invention said cooperating locking means may comprise a locking tab carried by said keel and a raised formation in a base panel of said carton, said locking tab and said raised formation being positioned for engagement when said keel is substantially fully erected. In constructions where the locking means includes a raised formation it may comprise a ridge formed by indenting said base panel from the face thereof remote from said keel.

In constructions where such a ridge is provided, a free edge of said locking tab which faces downwardly when said keel is erected may be caused to override said ridge to engage against a side surface thereof.

According to another feature of the invention said locking tab may be formed at a lower edge of a side wall panel of said keel structure. In constructions where the locking tab is formed at the lower edge of a side wall panel, a securing flap may be hinged to said side wall panel, said securing flap being secured in superposed relation on a base panel and said locking tab being struck from said securing flap adjacent the hinged connection between said securing flap and said side wall panel of the keel structure.

Another aspect of the invention provides a carton blank for forming a carton according to any of the preceding paragraphs.

An embodiment of the invention will now be described, by way of example, with reference to the accompanying drawings, in which.

Figure 4:
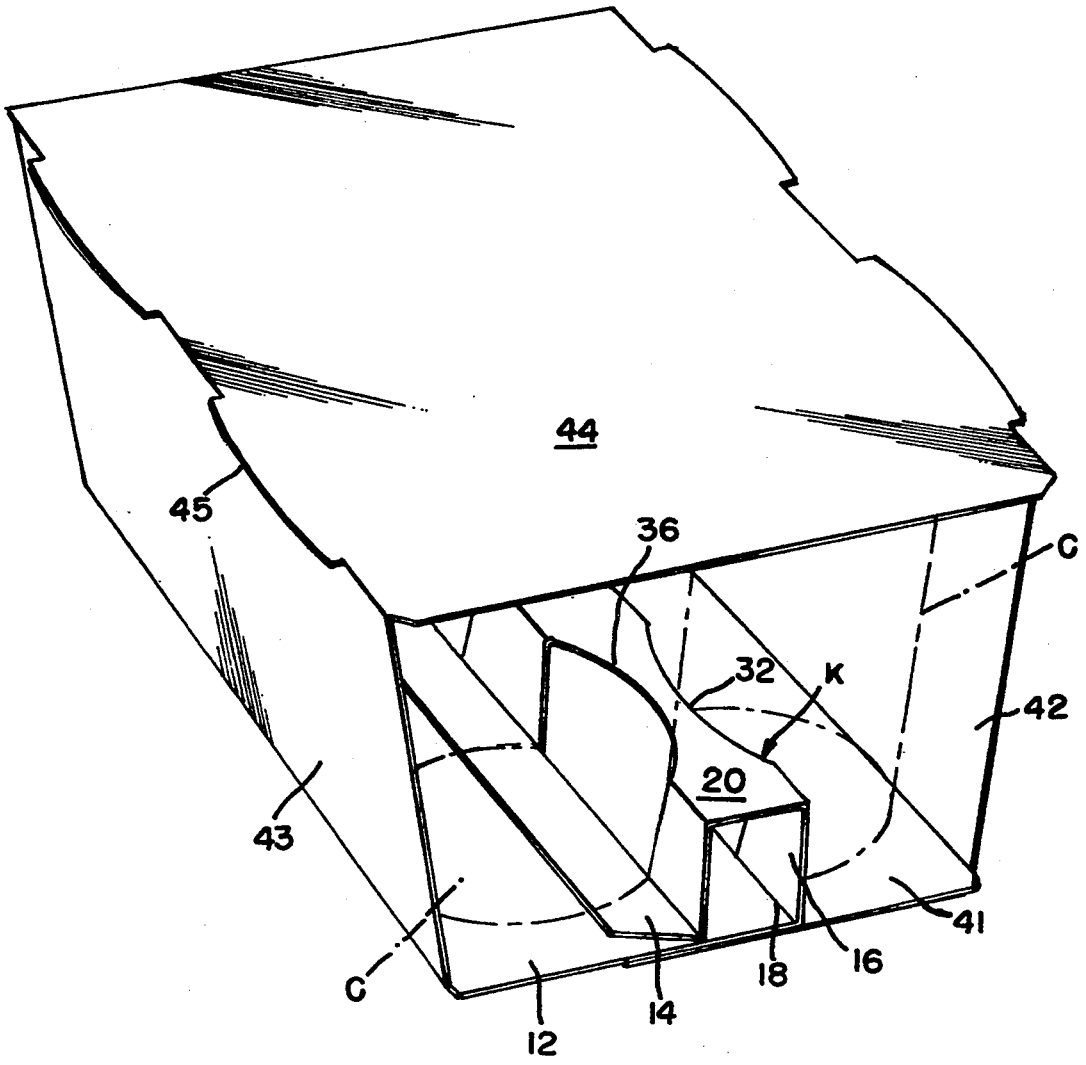
FIG. 4 is a perspective view of an assembled wraparound carton which incorporates the box keel of the present invention.

FIG. 4 shows a preferred embodiment of the invention as used in a wraparound carton for a plurality of cup-shaped containers C arranged in two rows. The carton is formed from a blank of paperboard or similarly foldable material and comprises opposing side walls 42, 43, top wall 44 overlying the tops of the articles and overlapping inner base panel 12 and outer base panel 41, the latter being secured to each other by suitable fastening means. For separating and retaining the cup-shaped articles, retaining slits 45 are provided at the juncture between top wall 44 and side walls 42, 43, in addition to the box keel structure K which will be described in detail hereinbelow.

Figure 1:
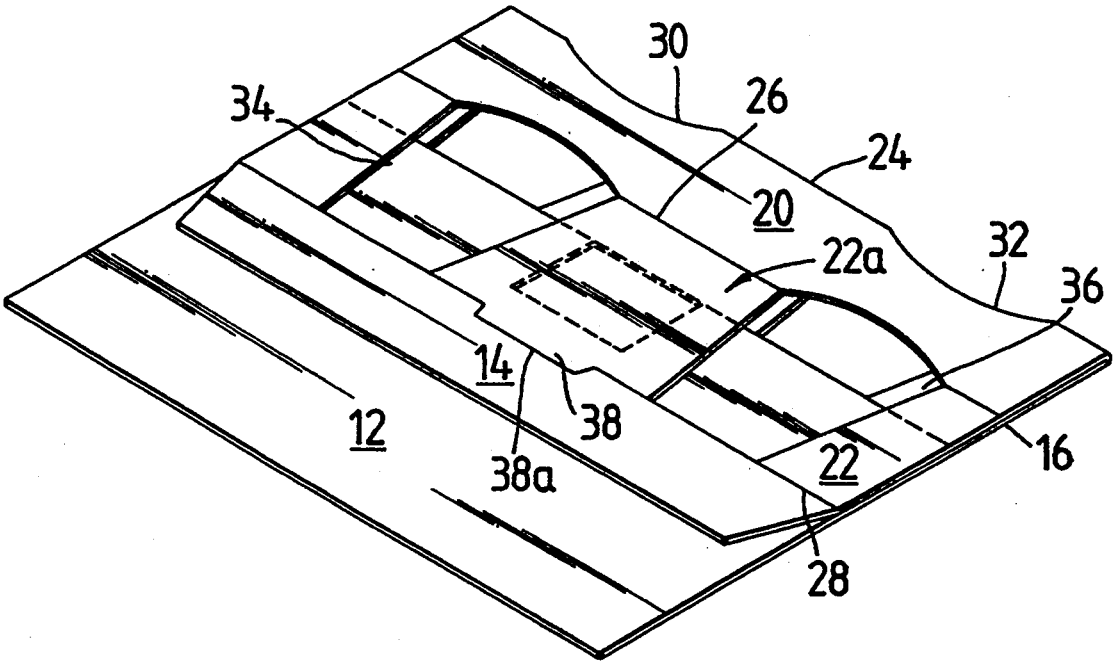
FIG. 1 is a perspective view from above of an end portion of a blank for forming a wraparound carton and which incorporates a box keel structure according to the invention with the keel shown in a flat collapsed condition.
Figure 2:
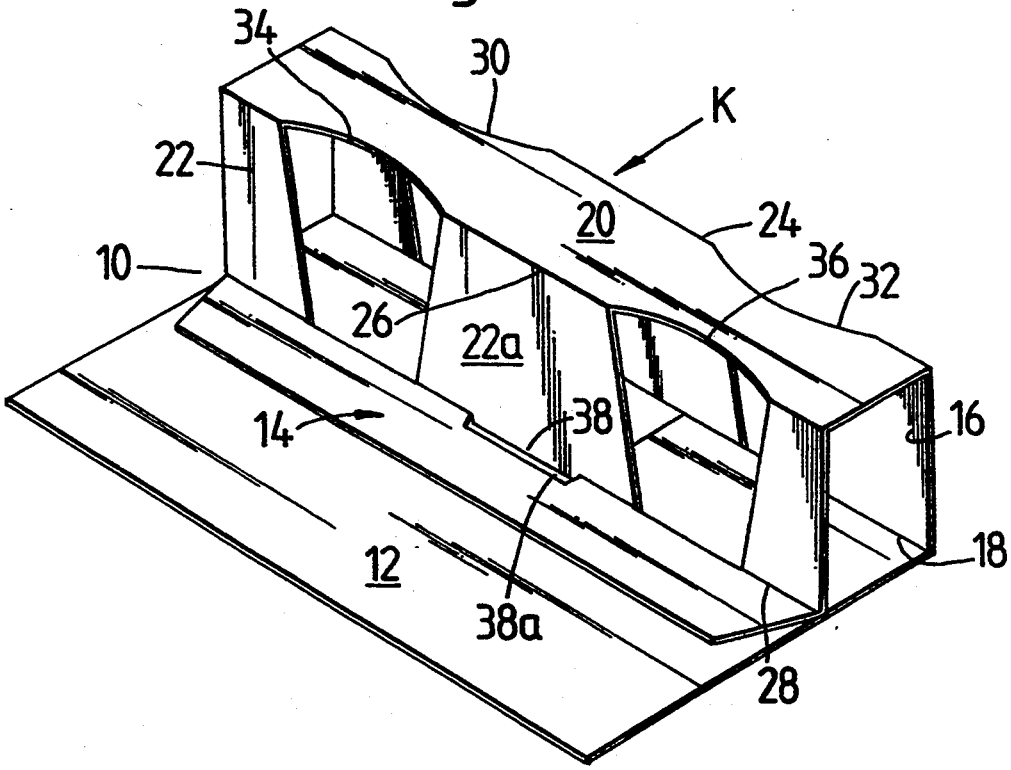
FIG. 2 is a perspective view of the same end portion of the blank of FIG. 1 but showing the keel in an erected condition.
Figure 3:
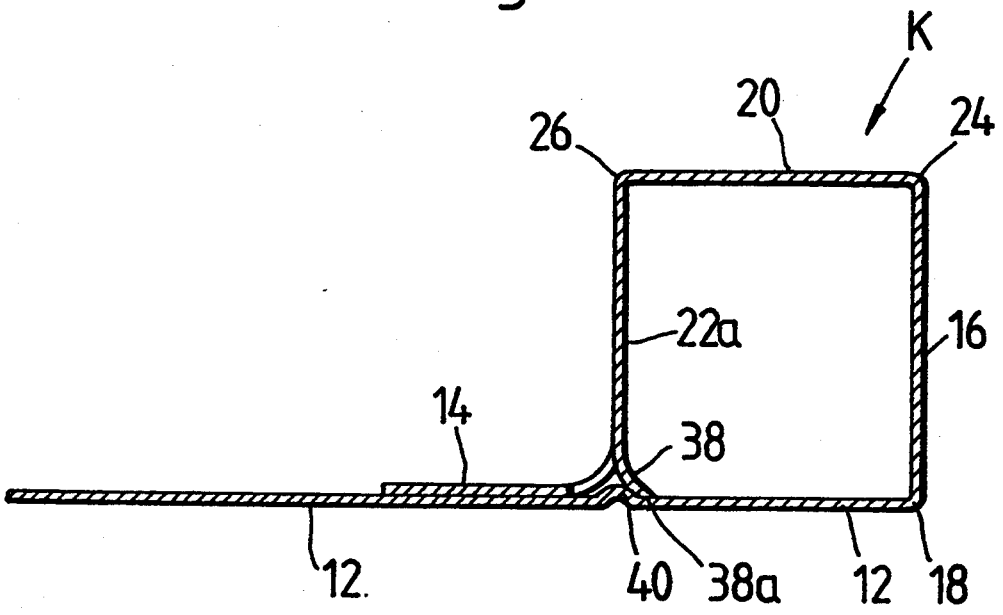
FIG. 3 is a vertical cross-section through a central part of the keel in erected condition.

FIG. 1 illustrates the box keel structure in collapsed condition extending from the inner base panel 12 and secured thereto by securing flap 14. As best seen in FIGS. 2 and 3, the box keel structure K comprises a first side wall panel 16 hinged along interrupted fold line 18 to the endmost edge of base panel 12, a top panel 20 and a second side wall panel 22. Top wall panel 20 is hinged to an end edge of side wall panel 16 remote from base panel 12 along interrupted fold line 24 and to the second side wall panel 22 along interrupted fold line 26. The second side wall panel is hinged to securing flap 14 along interrupted fold line 28. The fold lines 18 and 24 are interrupted by article retention openings 30, 32 struck from side wall 16 and fold lines 26 and 28 are interrupted by article retention openings 34, 36 struck from side wall 22. These retention openings are well known in the art and receive lower wall portions of articles e.g. plastic cups or pots, which are engaged by the keel structure in the carton.

The keel structure is erected from its flat collapsed condition shown in FIG. 1 by raising the side walls into an upright attitude whereby the structure hinges about fold lines 18, 24, 26 and 28.

In order to maintain the keel structure in its erected condition cooperating locking means is provided in part by the keel and in part by the base panel and is engaged automatically as a consequence of erecting the keel structure. The cooperating locking means includes a locking tab 38 which is struck from securing flap 14 so that it is integral with and extends downwardly from a central panel **22*a* of side wall 22 substantially along the interrupted fold line 28. Thus, the free edge 38*a* of the locking tab wipes across the upward facing surface of base panel 12. The cooperating locking means further includes an upwardly projecting ridge 40 on the base panel (FIG. 3) which is coextensive with the free edge 38*a* of the locking tab. The ridge is offset inwardly of the box keel in relation to side wall fold line 28 and when the keel is set up it is hinged overcentre so that edge 38***a* of the locking tab rides over the ridge and engages the side face thereof which is remote from securing tab 12. Thus, the keel is held upright against collapse in the setting up direction by the locking tab.

I claim:

1. A wraparound type carton for a group of articles arranged in two rows wherein overlapping inner and outer base panels cover the lower ends of said articles, the carton comprising a separating keel foldably joined to the end edge of said inner base panel or extending inwardly between said two rows of articles, said separating keel comprising two spaced apart side wall panels and having a locking tab depending from the lower end of one of said side wall panels, and a raised formation provided on said inner base panel to cooperate with said locking tab, said locking tab and said raised formation being arranged so that said locking tab is automatically interlocked with said raised formation when the keel is fully erected.

2. The wraparound carton as claimed in claim 1 wherein said raised formation comprises a ridge formed by indenting said inner base panel from a face thereof remote from said keel.

3. The wraparound carton as claimed in claim 2 wherein a free edge of said locking tab is caused to override said ridge to engage against a side surface thereof.

4. The wraparound carton according to claim 1 wherein a securing flap is hinged to said one side wall panel and secured in superposed relation on the interior surface of said inner base panel, said locking tab being struck from said securing flap.

5. A blank for a carton for a group of articles arranged in two rows, comprising a series of panels arranged to envelop three sides of said group of articles, and end panels to cover the fourth side of said group in overlapping relation with respect to each other when the carton is formed, one of said end panels including a separating keel structure to be disposed between said two rows of articles, said separating keel structure being formed from a series of keel panels foldably joined to a free end of said one of said end panels and comprising a first side panel, a top panel and a second side panel and a securing flap, said first side panel including a locking tab struck at least in part from said adjacent securing flap, said top panel, second side panel and securing flap being folded into flat face contacting overlapping relationship with said one of said end panels and said securing flap being adhered thereto, and a ridge formed in said one of said end panels and arranged so that said locking tab engages said ridge thereof when said separating keel structure is erected whereby said separating keel structure is automatically locked in erected condition.

6. The blank in accordance with claim 5 wherein said series of panels and said series of keel panels are constructed such that said keel structure is erected by applying an inward force to the joint between said top wall panel and said second side wall panel of said separating keel structure.

* * * * *